US012024353B2

(12) United States Patent
Jöbges

(10) Patent No.: US 12,024,353 B2
(45) Date of Patent: Jul. 2, 2024

(54) BEVERAGE CONTAINER

(71) Applicant: ARDAGH METAL BEVERAGE HOLDINGS GERMANY GMBH, Bonn (DE)

(72) Inventor: Udo Jöbges, Düren (DE)

(73) Assignee: Ardagh Metal Beverage Holdings Germany GmbH, Bonn (DE)

( * ) Notice: Subject to any disclaimer, the term of this patent is extended or adjusted under 35 U.S.C. 154(b) by 322 days.

(21) Appl. No.: 17/611,889

(22) PCT Filed: May 13, 2020

(86) PCT No.: PCT/EP2020/063385
§ 371 (c)(1),
(2) Date: Nov. 16, 2021

(87) PCT Pub. No.: WO2020/229565
PCT Pub. Date: Nov. 19, 2020

(65) Prior Publication Data

US 2022/0219880 A1 Jul. 14, 2022

(30) Foreign Application Priority Data

May 16, 2019 (DE) ..... 10 2019 112 818.8

(51) Int. Cl.
*B65D 81/32* (2006.01)
*B21D 22/28* (2006.01)
*B65D 85/73* (2006.01)

(52) U.S. Cl.
CPC ..... *B65D 81/3216* (2013.01); *B21D 22/28* (2013.01); *B65D 85/73* (2013.01)

(58) Field of Classification Search
CPC ..... B65D 81/3216; B65D 81/3222; B65D 81/3233; B65D 81/3244; B65D 81/3238; B65D 81/3277; B65D 85/73
(Continued)

(56) References Cited

U.S. PATENT DOCUMENTS 4,518,082 A * 5/1985 Ye ..... B65D 81/3222 206/217
4,679,706 A * 7/1987 Magid ..... B65D 83/625 222/402.18
(Continued)

FOREIGN PATENT DOCUMENTS

JP 2003-148287 5/2003
WO WO 93/25452 A1 12/1993
WO WO 97/00214 A2 1/1997

OTHER PUBLICATIONS

International Search Report received in PCT Application No. PCT/EP2020/063385, dated Jul. 24, 2020 in 2 pages.

*Primary Examiner* — Steven A. Reynolds
(74) *Attorney, Agent, or Firm* — Knobbe, Martens, Olson & Bear, LLP

(57) ABSTRACT

Fluid container (1) for arrangement in a beverage container (2), wherein the fluid container (1) extends in an axial direction (3) between a first end (4) and a second end (5) and has a first volume (7) for storing a fluid (8) inside a fluid container wall (6); wherein the fluid container (1) has, between the first end (4) and the second end (5), a central region (9) which has, in the axial direction (3), a constant cross-sectional area (10) which extends transversely to the axial direction (3), and a longitudinal axis (11) which extends parallel to the axial direction (3) and runs through a centroid point of the constant cross-sectional area (10).

4 Claims, 4 Drawing Sheets

(58) Field of Classification Search
USPC ..... 206/219; 220/505
See application file for complete search history.

(56) References Cited

U.S. PATENT DOCUMENTS

| | | | | | |
|---|---|---|---|---|---|
| 4,996,823 | A * | 3/1991 | Byrne | B65D 85/73 | 413/4 |
| 5,584,165 | A * | 12/1996 | Wright | B65D 85/73 | 426/115 |
| 5,670,194 | A * | 9/1997 | Fuller | B65D 85/73 | 426/115 |
| 5,683,732 | A * | 11/1997 | Baxter | B65D 85/73 | 426/115 |
| 6,123,189 | A * | 9/2000 | Falkenberg | B65D 77/283 | 206/217 |
| 7,073,257 | B1 | 7/2006 | Hsu | | |
| 7,325,688 | B1 * | 2/2008 | Tessmer | C11D 17/042 | 510/439 |
| 7,832,184 | B2 * | 11/2010 | Sillince | B65D 81/3222 | 53/511 |
| 2004/0178086 | A1 * | 9/2004 | Sawaguchi | B65D 51/24 | 206/217 |
| 2007/0290505 | A1 | 12/2007 | Lin et al. | | |
| 2013/0146485 | A1 * | 6/2013 | Karabinis | B65D 25/00 | 206/219 |
| 2022/0001407 | A1 * | 1/2022 | Nervo | B05B 11/104 | |

* cited by examiner

BEVERAGE CONTAINER

CROSS REFERENCE TO RELATED APPLICATIONS

This application is the U.S. National Phase Application under 35 U.S.C. § 371 of International Application No. PCT/EP2020/063385, filed May 13, 2020, which claims priority to German Application No. 10 2019 112 818.8, filed on May 16, 2019, the entire disclosure of each of which is hereby incorporated by reference.

The present invention relates to a fluid container for a beverage container, wherein the beverage container is in particular a (metal) beverage can. The beverage container serves to store contents, for example a liquid, and the fluid container, wherein the beverage container is at a reduced pressure relative to the surroundings or relative to an atmospheric pressure of approximately 1 bar in the sealed state (starting state). The fluid container is provided for arrangement in the beverage container, wherein the fluid container stores a fluid (a different fluid than the contents or the liquid of the beverage container) which, in particular when the beverage container is opened, escapes into the contents or the liquid of the beverage container.

Particularly in the case of beverage cans with carbonated contents, the beverage container can be at an internal pressure of up to 6.2 bar before it is opened for the first time.

A beverage container is known from EP 0 227 213 A2 in which a pressure container (widget) is arranged inside the beverage container. A gas is here stored in the pressure container which escapes from an aperture in the container when the beverage container is opened and causes the liquid stored in the beverage container to froth. The gas generally comprises an inert gas, possibly also carbon dioxide. The inert gas is, for example, nitrogen. The pressure container is arranged in a base region of the beverage container such that the gas escaping from the pressure container into the liquid excites the largest possible volume of liquid to form froth. To do this, the pressure container is arranged so that it is completely submerged in the liquid.

A beverage container is known from the subsequently published document DE 10 2018 110 764 in which a pressure container is arranged. This pressure container is arranged so that it is fixed in the beverage container in its position by means of a retaining element or by means of an adhesive.

The object of the invention is therefore to overcome at least partially the problems that exist in connection with the prior art and in particular to provide a fluid container (as a pressure container) which can be arranged in an alternative fashion and can be fixed with regard to its position.

These objects are achieved with a fluid container according to the features of claim 1. Further advantageous embodiments are provided in the dependent claims. It should be pointed out that the features which are explained individually in the dependent patent claims can be combined with one another in a technologically meaningful way and define further embodiments of the invention. The features provided in the claims are furthermore specified and explained in more detail in the description, wherein further preferred embodiments of the invention are described.

A fluid container is proposed for arrangement in a beverage container. The fluid container extends in an axial direction between a first end and a second end and has a first volume for storing a fluid inside a fluid container wall. The fluid container has, between the first end and the second end, a (sleeve-like, for example cylindrically shaped or rotationally symmetrical) central region which has, in the axial direction, a constant cross-sectional area which extends transversely to the axial direction, and a longitudinal axis which extends parallel to the axial direction and runs through a centroid point of the constant cross-sectional area. The fluid container has a first end region at least between the first end and the central region, wherein a) at least a part of the first end region is formed by the contacting of opposing regions of the fluid container wall; and/or b) the first end region has, in the axial direction, first cross-sectional areas, which extend transversely to the axial direction, with first centroid points, wherein at least some of the centroid points are arranged so that they are spaced apart from the longitudinal axis in the radial direction.

The fluid container in particular has a fluid container wall made from a plastic, in particular polypropylene, or alternatively from a different material. The fluid container wall has a wall thickness of in particular no more than one (1) millimetre, preferably no more than 0.5 millimetre, particularly preferably 0.25 millimetre.

The fluid container has at least in the central region a diameter of no more than 20 millimetres, preferably no more than 13 millimetres. In particular, the diameter is at least 5 millimetres, preferably at least 10 millimetres.

The first volume enclosed by the fluid container can be connected to surroundings of the fluid container via at least one or precisely one aperture. The first volume is then formed in particular by means of a fluid container wall which is conceived as sealed. The at least one aperture has in particular a maximum aperture diameter of 0.5 millimetre. The fluid container can also be designed without an aperture.

The central region comprises in particular at least 25%, preferably at least 50%, particularly preferably at least 75%, of the first volume.

The central region extends in particular in the axial direction over at least 25%, preferably over at least 50%, preferably at least 75%, of a container length, extending between the first end and the second end along the longitudinal axis, of the fluid container.

The central region has a constant cross-sectional area which is formed by the fluid container wall and the area enclosed by the latter in the cross-section. The constant cross-section has a centroid point which is arranged in particular within the constant cross-sectional area (in a cylindrical configuration of the central region, the constant cross-sectional area therefore has, for example, a circular shape, wherein the centroid point is arranged in the centre of the circle).

The longitudinal axis extends in particular through all the centroid points of the constant cross-sectional areas of the central region.

The first end region in particular has a shape which differs from the central region. In particular, the first end region has a form which is not rotationally symmetrical with respect to the longitudinal axis.

The first end region is in particular formed, for example, starting from a shape which corresponds to the shape in the central region, by compression of the fluid container wall which takes place essentially transversely to the longitudinal axis, wherein regions of the fluid container wall which had previously been arranged opposite and spaced apart from one another now contact (and bear against) one another as a consequence of the compression and may be connected to one another, for example materially.

In particular, alternatively or additionally, the first end region has, in the axial direction, first cross-sectional areas which extend transversely to the axial direction and are formed by the fluid container wall and by the area which may be enclosed by it in the respective first cross-section. These first cross-sectional areas each have first centroid points, wherein at least some of the first centroid points are arranged spaced apart from the longitudinal axis in a radial direction.

In particular, the first centroid points lie, aligned along the longitudinal axis, within the constant cross-sectional areas of the central region.

The first centroid points are in particular arranged within a first cross-sectional area associated with the respective first centroid point.

In particular, at least some of the first centroid points are arranged outside a first cross-sectional area associated with the respective first centroid point. Such a configuration can exist, for example, if the first cross-sectional area extends in a crescent shape.

In particular, the regions (of the fluid container wall) which contact one another form a connecting region which extends transversely to the longitudinal axis over a width and along the longitudinal axis over a length. In particular, the length is greater than the wall thickness of the fluid container wall, in particular by a factor of at least two (2), preferably by a factor of at least five (5), particularly preferably by a factor of at least ten (10).

In the connecting region, the fluid container in particular does not have a first volume enclosed by the fluid container walls.

In particular, at least a part of the connecting region has a curved (i.e. particularly a non-straight) profile over the width (i.e. over the first cross-sectional area).

In particular, the fluid container has at least one aperture, possibly also a plurality of apertures, in the first end region. The at least one aperture connects the first volume within the fluid container, via the fluid container wall, to surroundings which are present outside the fluid container. In particular, the at least one aperture (in particular each of the apertures) is situated outside the connecting region.

In particular, the designs for the first end region also apply for the second end region, wherein both end regions can also be designed differently.

In particular, the second end region is designed identically to the first end region, wherein the second end region preferably does not have an aperture.

In particular, the aperture is pierced, for example by a needle. A needle with a diameter of 0.14 millimetre can be used, for example, to form an aperture with a diameter of 0.1 millimetre. The smaller diameter is a result of the partially elastic deformation of the container material during the piercing process.

Compared with containers produced using an injection-moulding process, the apertures of which are then formed by, for example, core pulls, smaller apertures can be produced in a reproducible fashion by means of piercing.

A method for producing the described fluid container is furthermore proposed. The method comprises at least the following steps:

a) providing a sleeve-like body which extends in the axial direction between a first body end and a second body end and has, in the axial direction, a constant cross-sectional area extending transversely to the axial direction;

b) (first) deformation of at least the first body end relative to the first end region;

c) connecting opposing regions of the fluid container wall in at least a part of the first end region and forming a connecting region.

In particular, the constant cross-sectional area of the body is the constant cross-sectional area of the fluid container produced from the body.

In particular, a body end of the body ends at a height, relative to the axial direction, which is the same circumferentially. It is, however, also possible that at least one body end runs relative to the axial direction at an angle of less than 90 degrees, in particular between 45 and 80 degrees.

In particular, step b) comprises a thermal (first) deformation during which the body is heated at least partially. In particular, a plastic (first) deformation is enabled by providing an elevated temperature such that the deformed body is to the maximum extent possible prevented from springing back elastically.

In particular, the (theoretical) volume of the sleeve-like body is reduced to the first volume by the first deformation.

In particular, a plastic (first) deformation takes place in step b), i.e. the first body end is permanently deformed.

In particular, the (first) deformation comprises pressing the opposing container walls together, wherein, starting from the central region, the first centroid points which now result are shifted outwards in the radial direction at an increasing distance from the longitudinal axis the nearer to the end of the fluid container. At least a part of the respective end region can be pressed together to such an extent that opposing regions of the fluid container wall can be brought to bear against each other. A connecting region can then be generated in this part of the end region by connecting the container walls.

Step c) comprises in particular a connecting method, for example a thermal connecting method, for example welding, in particular pulse welding.

In particular, steps b) and c) take place simultaneously.

In particular, after step c) a (second) deformation takes place of at least a part of the connecting region or of the regions connected together in step c).

In particular, the second deformation also comprises thermal deformation. In particular, the second deformation does not comprise any reduction in the first volume. Preferably only a connecting region is deformed by the second deformation. In particular, at least a part of the connecting region is given a curved profile over the width (i.e. over the first cross-sectional area) by the second deformation.

In particular, as part of a thermal deformation, the body is heated at least partially (preferably in the region to be deformed) to a (locally) elevated temperature and is then deformed. The temperature is in particular at least 60 degrees Celsius, preferably at least 100 degrees Celsius.

In particular, the fluid container is cut to size at least in the first end region during or after step b).

The cutting to size preferably takes place during or after step c).

In particular, the cutting to size also takes place after the second deformation (of the connecting region).

The container length of the fluid container is set by the cutting to size.

The cutting to size can be effected by separating (for example, cutting) material from the body. Alternatively, the cutting to size can also comprise a deformation (for example, folding, buckling, etc) by means of which a container length is set. It is furthermore possible that the cutting to size comprises a thermal or chemical conversion of material of the body.

In particular, as part of the method, at least one aperture is arranged or produced in the region of the first end. The aperture is preferably introduced during or after step c). The aperture is particularly preferably introduced after the second deformation and/or after the cutting to size.

In particular, as part of step b), the second body end is additionally deformed to form a second end region.

The designs of the first body end apply in particular equally for the second body end, it also being possible for the two body ends to be designed differently.

In particular, the second body end is configured identically to the first body end, the second body end preferably not having an aperture.

In particular, a cutting to size of the fluid container in the second end region takes place during or after step b).

In particular, at least partial filling of the body or the fluid container with a fluid takes place before the fluid container is completely sealed.

Alternatively, it is possible for the fluid container not to be filled with a fluid at all (other than surrounding air or the surrounding atmosphere) such that the fluid container is filled only at a later point in time and then via the at least one aperture.

A gas, a liquid or a solid, for example a powder, can be used as the fluid. The fluid can be composed of multiple different fluids, for example also of fluids in powder and gaseous forms, fluids in powder and liquid form, etc. In particular, the physical state of the fluid inside the fluid container can change over time.

A (metal) beverage container is proposed, at least comprising a shell (which is leakproof in the starting state) with a base, a lid and a (cylindrical) wall region connecting the base to the lid. The beverage container has a second volume which can be partly filled with (a third volume of) a liquid (or is filled with it in the starting state). The described fluid container is arranged inside the second volume.

The beverage container is in particular a beverage can.

In an upright state of the beverage container, the base is at the bottom and the lid at the top relative to the direction of gravity. In particular, the wall region between the base and the lid extends in an axial direction (essentially) parallel to the direction of gravity (in the case of a beverage container standing upright) and completely around the base and the lid in the circumferential direction.

In a starting state, the beverage container is in particular at a first pressure which is greater than a second pressure of the surroundings (in particular, the second pressure is no more than 1.1 bar and the first pressure is preferably at least 2.5 bar). As long as the beverage container is situated in the starting state, the pressure inside the volumes (first volume, second volume, third volume) is in particular the same in each case.

In the starting state, the fluid container is at least partly filled with a fluid (for example, a gas but possibly additionally filled with the liquid, in particular from the third volume). When the beverage container is opened and pressure equalization with the surroundings takes place, at least the fluid (possibly also the liquid) escapes from the first volume, for example via the at least one aperture, into the liquid or into the third volume.

The fluid container or the connecting region can in particular be designed such that, when the beverage container is opened and pressure equalization with the surroundings takes place, the fluid container, which is otherwise designed as sealed, bursts open, in particular at a point provided for this purpose, such that the fluid can escape from the fluid container into the liquid.

The second volume is in particular between 0.1 and 5 litres, preferably no more than 3 litres, particularly preferably no more than 1.5 litres.

The third volume is in particular between 1% and 10%, preferably between 1% and 5%, less than the second volume.

The first volume is in particular between 1% and 5%, preferably between 1% and 3%, of the second volume.

In particular, the total of the first volume and the third volume is at least 1% less than the second volume.

The beverage container is generally opened via an activatable sealing aperture in the lid. In particular, the sealing aperture cannot be resealed and the elevated pressure prevailing in the beverage container in the starting state can be recreated by resealing the sealing aperture only to a limited extent.

The beverage container extends in particular from the base to the lid in an axial direction. The axial direction preferably runs parallel to the wall region. In particular, the beverage container has an essentially cylindrical design and (apart from structures, for example, in the lid, for example to open/close the second volume) has an axis of rotation or axis of symmetry which extends parallel to the axial direction.

In particular, the beverage container comprises at least one first core bevel (first shoulder) running around in the circumferential direction between the base and the wall region, or in the base, and a second core bevel (second shoulder) arranged opposite the first core bevel and running around in the circumferential direction between the lid and the wall region, or in the lid. A maximum height of the second volume extends between the first core bevel and the second core bevel (in the axial direction).

The fluid container is in particular arranged with the first end in the first core bevel and with the second end in the second core bevel and arranged in a form-fitting fashion in the second volume via the core bevels relative to a radial direction.

In particular, the fluid container extends between the first end and the second end over a container length, wherein the container length is no more than 5 millimetres less than the maximum height.

The particular design of at least the fluid container enables the fluid container to be arranged in the beverage container so that it is permanently fixed in place.

In particular, an additional retaining element or an adhesive can, for example, thus be dispensed with. An adhesive may be used to arrange the fluid container at least temporarily in the beverage container, for example on the wall region.

In particular, the fixing of the fluid container in the core bevels makes it possible for an at least temporary softening of an adhesive (for example, as part of pasteurization of the liquid stored in the beverage container) not to cause the fluid container to be displaced in the beverage container.

In particular, a beverage container can therefore have the wall region and a base and lid and, as a shell of this type, be filled with a liquid, wherein the fluid container can be already arranged in the beverage container (and may, for example, be fixed in the beverage container via an adhesive). After the fluid container has been arranged, whichever of the base and lid is absent can be provided to seal the beverage container, wherein the fluid may be provided before the sealing.

The second volume has the maximum height (namely between the core bevels) in particular between the base and the lid in an axial direction, wherein the fluid container has a container length in the axial direction between the first end and the second end which is at least 85% of the maximum height. The container length is particularly preferably at least 90% or even at least 95% of the maximum height, particularly preferably at least 99.5% of the maximum height.

In particular, the first volume of the fluid container extends, in the case of an upright beverage container, as far as an upper region adjacent to the lid, wherein the upper region is situated above a predetermined fill level of the liquid.

In particular, the second volume has, in the case of an upright beverage container, at least one lowest point (in the first core bevel). The first end of the fluid container extends into the first core bevel and as far as the lowest point or at least as far as a region close thereto. The first volume of the fluid container which is filled or can be filled with a fluid extends as far as a lower region adjacent to the base, in particular such that the at least one aperture is arranged no more than 20 millimetres, in particular no more than 10 millimetres, preferably no more than 6 millimetres, and particularly preferably no more than 4 millimetres away from the lowest point.

The previously known gas-filled pressure containers or fluid containers in beverage containers were generally arranged centred relative to the base and relative to the wall region. These fluid containers were here arranged so that they abutted the base which was (generally) curved inwards into the second volume and were optionally then fastened thereto by means of an adhesive. The arrangement on the curved base inevitably entails that an aperture in the fluid container is arranged at a greater distance from a lowest point of a second volume. However, up until now only a smaller partial volume of a liquid stored in the beverage container could thus be excited in order to react with the fluid, for example in order to form froth.

The fluid container proposed in the present case and which extends in the axial direction and vertically can, by virtue of its smaller extent in a radial direction, also be arranged off-centre with respect to the base or with respect to the second volume. The pressure container can thus be arranged in particular (immediately) adjacent to the wall region and extend into the core bevels of the beverage container (the lowest rim of the beverage container which generally extends around the around the curved base).

As a consequence of the arrangement of the at least one aperture at a small distance from the lowest point, a larger partial volume of the third volume can be excited by the outflow of at least the fluid from the fluid container.

In particular, the fluid container extends into both core bevels of the beverage container such that it is fixed in its place (i.e. extending into both core bevels) via the core bevels at least relative to a radial direction.

In particular, the fluid container can be elastically deformed at least at one end, preferably at both ends, (in particular exclusively) by the beverage container (preferably by the core bevel or by both core bevels) so that the pressure container is also fixed in its place relative to a circumferential direction in the core bevels and in the first volume.

In particular, the fluid container is arranged at least with the first end or with the second end (immediately) adjacent to a wall (for example, the base, the lid or the wall region) of the beverage container such that abutment between the end and the wall is formed at least relative to an axial direction. In particular, the fluid container is arranged with respect to the wall such that further displacement of the pressure container in the axial direction forces at least displacement of that end of the fluid container which contacts the wall in the radial direction or in the circumferential direction. Adjacent in this connection means in particular that the end is arranged at a distance of no more than 2 millimetres from the wall. Immediately adjacent then means that the end contacts the wall.

In particular, at least one end of the fluid container has, in the region of a connecting region, a curved profile which is designed such that it matches the profile of the corresponding core bevel in the circumferential direction.

In particular, both ends are arranged (immediately) adjacent to in each case a wall such that further movement of the fluid container in the axial direction is at least restricted.

In particular, detachment of the fluid container and the development of noises owing to movement of the fluid container relative to the beverage container can be prevented.

Alternatively, the fluid container can be connected using an adhesive to a wall (in particular to the wall region) of the beverage container, wherein the pressure container is additionally fixed in its place or is even fixed in its place in a force-fitting fashion (for example, as a consequence of an at least elastic deformation or by a retaining element), at least relative to a radial direction, for example by extending into the core bevels of the beverage container.

The beverage container and the fluid container can be filled in a known manner, for example as follows:

- providing a shell comprising a base and a wall region, with no lid;
- providing the fluid container (for example, with an aperture, optionally already filled with fluid or with no fluid);
- arranging the fluid container in the shell; optionally using an adhesive;
- filling the shell with the liquid (third volume)
- optionally filling the shell (starting from the third volume, in particular up to no further than the second volume) with fluid, for example with inert gas (optionally at least partly liquefied);
- (gas-tightly) sealing the shell with the lid and forming the beverage container;
- optionally upturning the beverage container such that the base faces upwards (relative to the direction of gravity) and such that the at least one aperture which may be present is arranged above the fill level of the second volume with the liquid;
- optionally filling the fluid container via the aperture with the fluid, for example with the inert gas, which expands by being heated in the closed beverage container or by changing the physical state of the inert gas and the resulting expansion of the inert gas;
- providing the beverage container in a starting state.

The embodiments of the fluid container apply equally for the beverage container and the method, and vice versa.

As a precaution, it should be pointed out that the numerical terms used here ("first", "second", "third", etc) principally serve (only) to distinguish several similar objects, sizes or processes, i.e. in particular do not necessarily prescribe any relative dependency and/or sequence for these objects. Where a dependency and/or sequence is required, this is explicitly stated here or it is obvious for a person skilled in the art when studying the specifically described embodiment.

The invention and the technical environment are explained in detail below with the aid of the drawings. It should be pointed out that it is not intended that the invention is limited by the exemplary embodiments shown.

In particular, unless explicitly stated otherwise, it is also possible to extract partial aspects of the content explained in the drawings and to combine them with other constituent parts and insights from the present description and/or drawings. The same reference numerals refer to the same objects such that explanations may additionally be taken from other drawings. In the schematic drawings.

Figure 1:
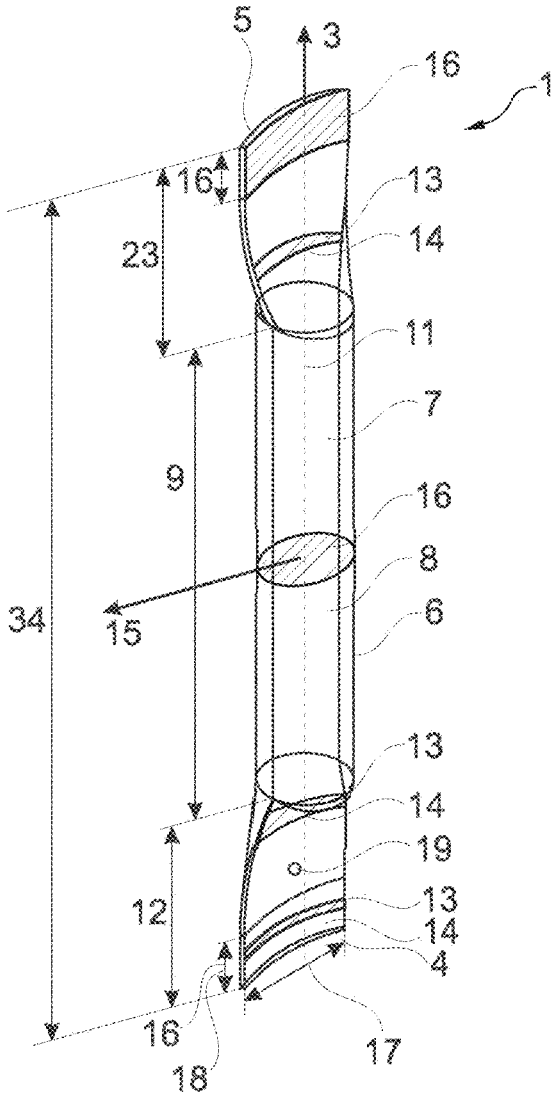
FIG. 1 shows a fluid container in a perspective view.
Figure 2:
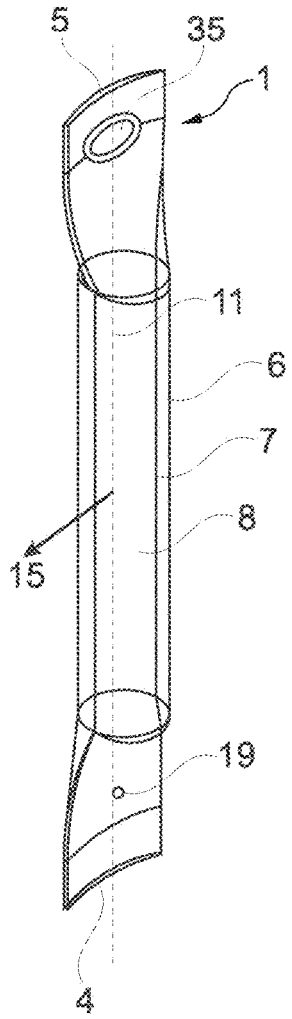
FIG. 2 shows the fluid container according to FIG. 1, with adhesive, in a perspective view.

FIG. 1 shows a fluid container 1 in a perspective view. FIG. 2 shows the fluid container 1 according to FIG. 1, with adhesive 35, in a perspective view. FIGS. 1 and 2 are described together below.

The fluid container 1 extends in an axial direction 3 between a first end 4 and a second end 5 and has a first volume 7 for storing a fluid 8 inside a fluid container wall 6. The fluid container 1 has, between the first end 4 and the second end 5, a (sleeve-like, for example cylindrically shaped or rotationally symmetrical) central region 9 which has, in the axial direction 3, a constant cross-sectional area 10 extending transversely to the axial direction 3 and a longitudinal axis 11 extending parallel to the axial direction 3 and running through a centroid point of the constant cross-sectional area 10. The fluid container 1 has a first end region 12 between the first end 4 and the central region 9. A part of the first end region 12 is formed by the contacting of opposing regions of the fluid container wall 6 and the first end region 12 has, in the axial direction 3, first cross-sectional areas 13 extending transversely to the axial direction 3 and with first centroid points 14, wherein at least some of the first centroid points 14 are arranged spaced apart from the longitudinal axis 11 in a radial direction 15 (see FIG. 4).

The first volume 7 enclosed by the fluid container 1 is connected to surroundings of the fluid container 1 via precisely one aperture 19.

Starting from a shape corresponding to the shape in the central region 9, the first end region 12 is formed by compression of the fluid container wall 6 which takes place essentially transversely to the longitudinal axis 11, wherein those regions of the fluid container wall 6 which were arranged beforehand opposite one another and spaced apart from one another now contact one another (and bear against one another) as a consequence of the compression and are connected to one another, for example materially.

The first end region 12 has, in the axial direction 3, first cross-sectional areas 13 extending transversely to the axial direction 3 and which are formed by the fluid container wall 6 and by the area which may be enclosed by it in the respective first cross-section. These first cross-sectional areas 13 each have first centroid points 14 which lie, aligned along the longitudinal axis 11, within the constant cross-sectional area 10 of the central region 9 (see FIG. 4). The first centroid points 14 are partly arranged within a first cross-sectional area 13 associated with the respective first centroid point 14. Some of the first centroid points 14 (towards the ends 4, 5) are arranged outside a first cross-sectional area 13 associated with the respective first centroid point 14. Such a design exists, as illustrated, if the first cross-sectional area extends in a crescent shape.

The regions of the fluid container wall 6 which contact one another form a connecting region 16 which extends transversely to the longitudinal axis 11 over a width 17 and along the longitudinal axis 11 over a length 18. The connecting region 16 has a curved (i.e. particularly a non-straight) profile over the width (i.e. over the first cross-sectional area 13).

The designs for the first end region 12 also apply, as illustrated, for the second end region 23, which has an identical design to the first end region 12, wherein the second end region 23 does not have an aperture 19.

Figure 3:
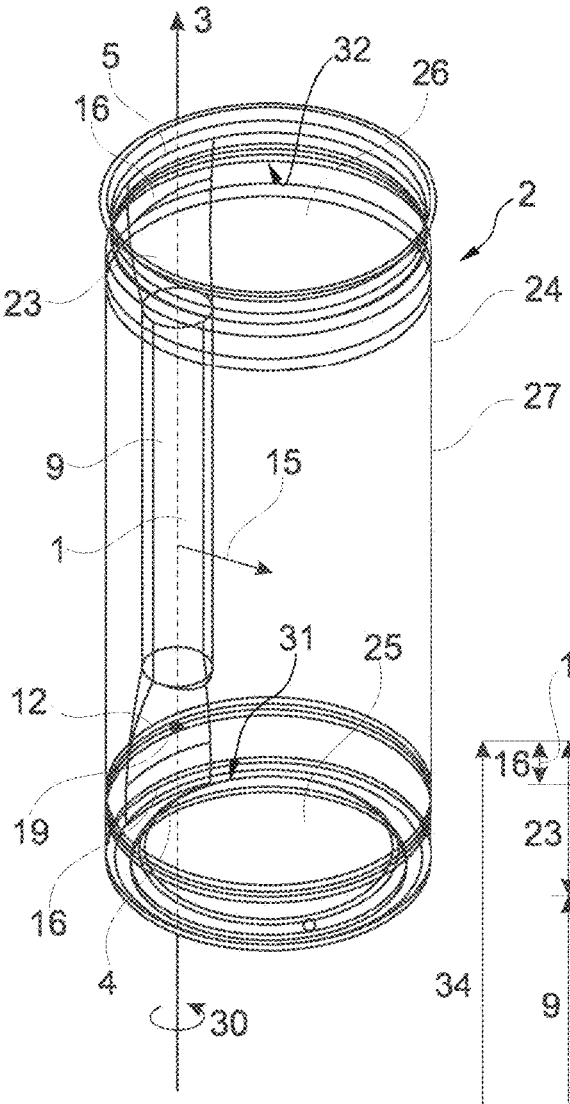
FIG. 3 shows a beverage container with a fluid container arranged therein, in a perspective, partly transparent view.
Figure 4:
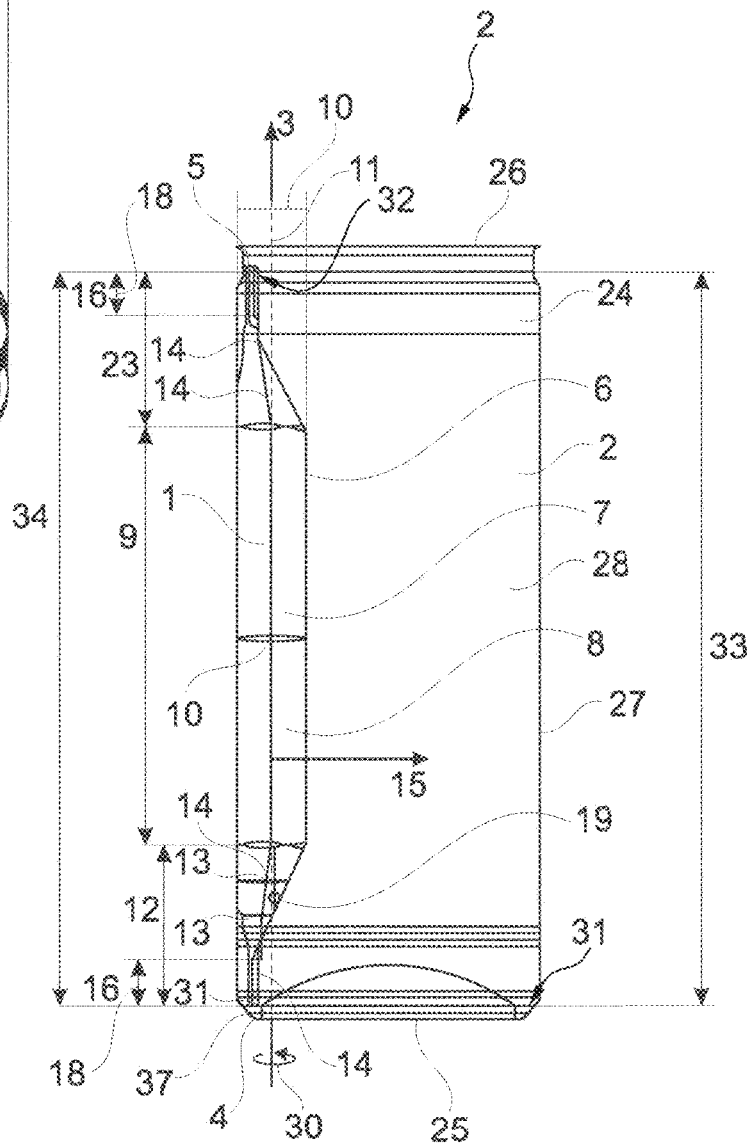
FIG. 4 shows the beverage container according to FIG. 3 with the fluid container, in a partly transparent side view.
Figure 5:
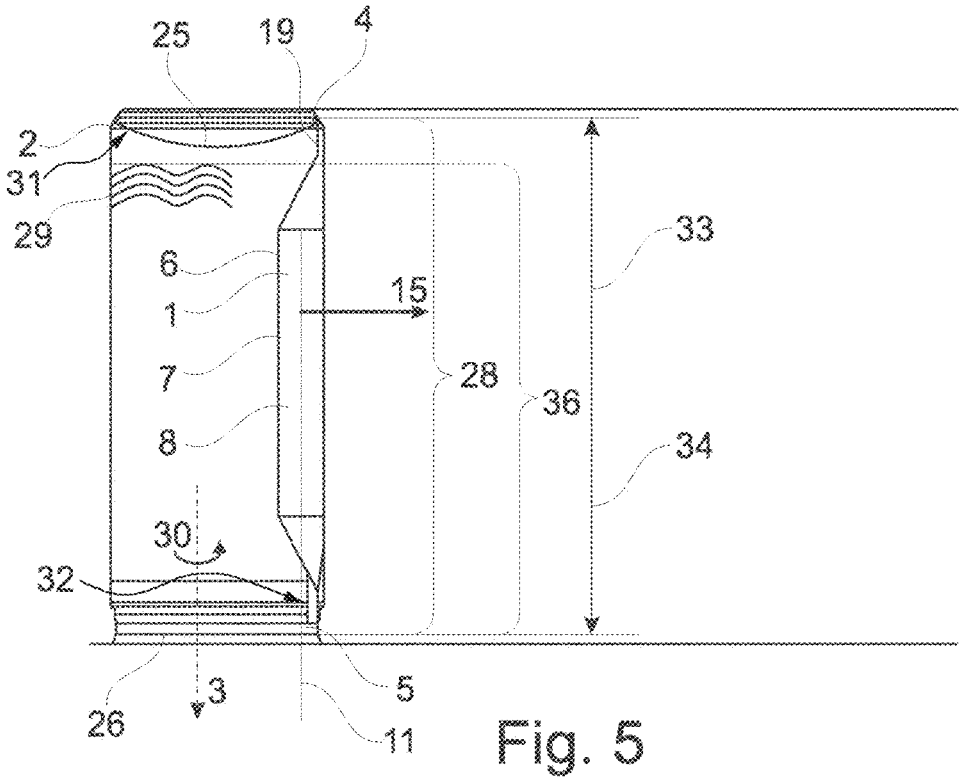
FIG. 5 shows the beverage container according to FIGS. 3 and 4, upside down in a side view.
Figure 6:
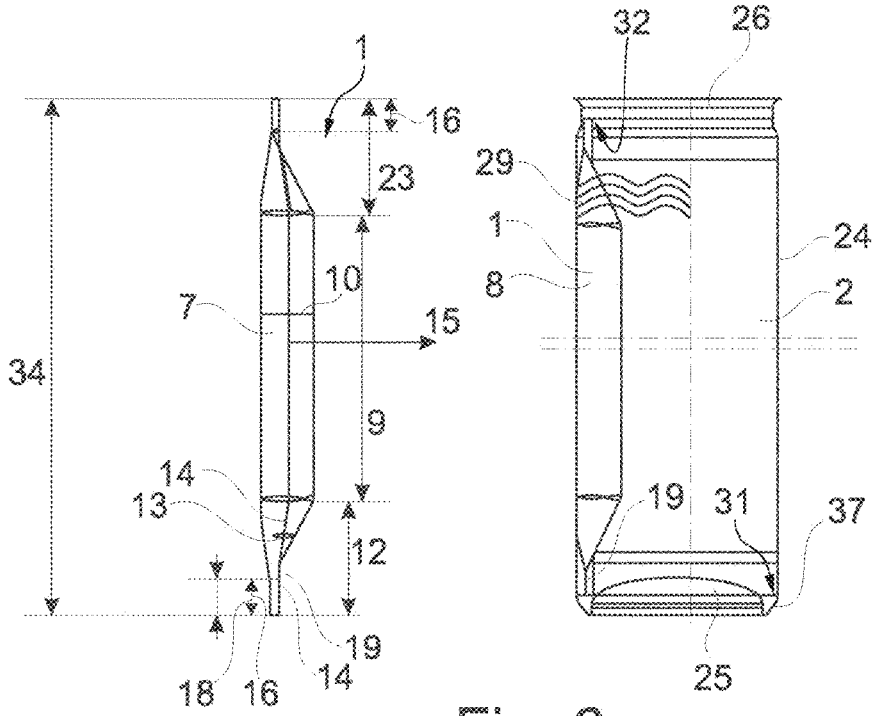
FIG. 6 shows the beverage container according to FIGS. 3 to 5 and the fluid container, in a side view.

FIG. 3 shows a beverage container 2 with a fluid container 1 arranged therein, in a perspective, partly transparent view. FIG. 4 shows the beverage container 2 according to FIG. 3 with the fluid container 1, in a partly transparent side view. FIG. 5 shows the beverage container 2 according to FIGS. 3 and 4, upside down, in a side view. FIG. 6 shows the beverage container 2 according to FIGS. 3 to 5 and the fluid container 1, in a side view. FIGS. 3 to 6 are described together below. Reference is made to the embodiments in FIGS. 1 and 2.

The beverage container 2 comprises a shell 24 (which is leakproof in the starting state) with a base 25, a lid 26 and a cylindrical wall region 27 connecting the base 25 to the lid 26. The beverage container 2 has a second volume 28 which is partially filled with a third volume 36 of a liquid 29. The fluid container 1 is arranged inside the second volume 28.

The beverage container 2 comprises a first core bevel 31 which runs around in a circumferential direction between the base 25 and the wall region 27, or in the base 25, and a second core bevel 32 which is arranged opposite the first core bevel 31 and runs around in the circumferential direction 30 between the lid 26 and the wall region 27, or in the lid 26. A maximum height 33 of the second volume extends between the first core bevel 31 and the second core bevel 32 in the axial direction 3.

The fluid container 1 is arranged with the first end 4 in the first core bevel 31 and with the second end 5 in the second core bevel 32 and arranged in a form-fitting fashion in the second volume 28 via the core bevels 31, 32 relative to a radial direction 15.

The particular design of the fluid container 1 enables the fluid container 1 to be arranged in the beverage container 2 so that it is permanently fixed in place.

The second volume 28 has, in the case of an upright beverage container 2, at least one lowest point 37 (in the first core bevel 31). The first end 4 of the fluid container 1 extends into the first core bevel 31 and as far as the lowest point 37 or at least as far as a region close thereto. The first volume 7 of the fluid container 1 which is filled with a fluid 8 extends as far as a lower region adjacent to the base 25 such that an aperture 19 is arranged only slightly removed from the lowest point 37.

The fluid container 1 proposed in the present case and which extends in the axial direction 3 can, by virtue of its smaller extent in a radial direction 15, be arranged, as illustrated, off-centre with respect to the base 25 or with respect to the second volume 28. The fluid container 1 can thus be arranged immediately adjacent to the wall region 27 and extend into the core bevels 31, 32 of the beverage container 2 (the lowest or highest rim of the beverage container 2 or of the second volume 28 which generally extends around the around the curved base 25 and around the lid 26).

As illustrated, the fluid container 1 extends with its ends 4, 5 into both core bevels 31, 32 of the beverage container 2 such that it is fixed in its place (i.e. extending into both core bevels 31, 32) via the core bevels 31, 32 at least relative to a radial direction 15.

Both ends 4, 5 of the fluid container 1 have, in the region of the respective connecting region 16, a curved profile which is designed such that it matches the profile of the corresponding core bevel 31, 32 in the circumferential direction 30.

Both ends 4, 5 are here arranged immediately adjacent to in each case a wall such that further movement of the fluid container 1 in the axial direction 3 is at least restricted.

Figure 7:
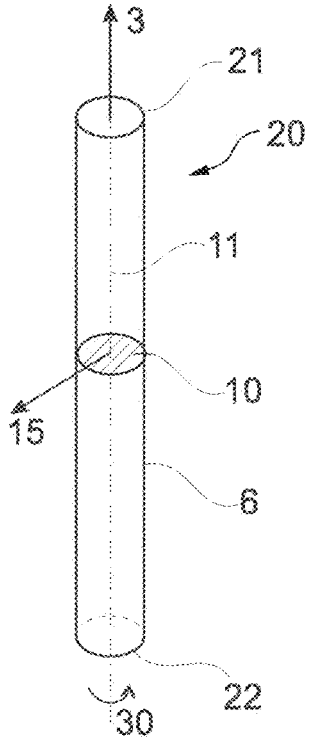
FIG. 7 shows a body for producing the fluid container, in a perspective view.
Figure 8:
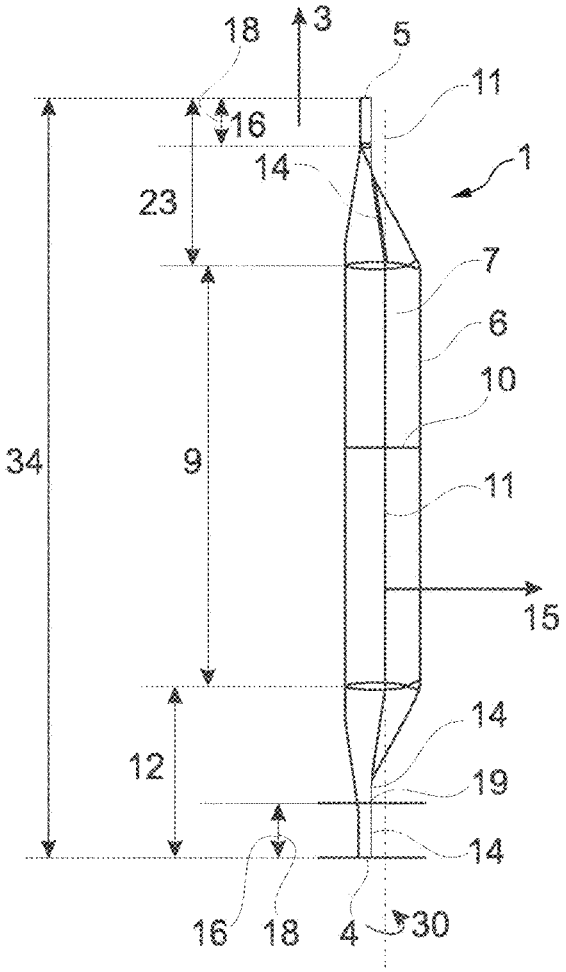
FIG. 8 shows the fluid container according to FIGS. 1 and 2, in a side view.

FIG. 7 shows a body 20 for producing the fluid container 1 in a perspective view. FIG. 8 shows the fluid container 1 according to FIGS. 1 and 2 in a side view. FIGS. 7 and 8 are described together below. Reference is made to the embodiments in FIGS. 1 to 6.

The method for producing the fluid container 1 comprises, according to step a), providing a sleeve-like body 20 which extends in the axial direction 3 between a first body end 21 and a second body end 22 and has, in the axial direction 3, a constant cross-sectional area 10 extending transversely to the axial direction 3. According to step b), a first deformation of the first body end 21 relative to the first end region 12 and of the second body end relative to the second end region 23 takes place. According to step c), connection of opposing regions of the fluid container wall 6 in respectively a part of the first end region 12 and of the second end region 23 and the respective forming of a connecting region 16 take place.

It can be seen in FIG. 7 that the body ends 21, 22 of the body 20 end in each case at a height, relative to the axial direction 3, which is the same circumferentially.

The (theoretical) volume (visible in FIG. 7 between the body ends 21, 22) of the sleeve-like body 20 is reduced to the first volume 7 by the first deformation. The first deformation comprises pressing the opposing container walls 6 together in the end regions 12, 23, wherein, starting from the central region 9 of the body 20, the first centroid points 14 which now result are shifted outwards in the radial direction 15 at an increasing distance from the longitudinal axis 11 the nearer to the end 4, 5 of the fluid container 1. At least a part of the respective end region 12, 23 is pressed together to such an extent that opposing regions of the fluid container wall 6 can be brought to bear against each other. A connecting region 16 is then generated in this part of the end region 12, 23 by connecting the container walls 6.

After step c), a second deformation takes place of at least a part of the connecting region 16 or of the regions connected to each other in step c). The second deformation does not cause any further reduction in the first volume 7. Only the connecting regions 16 are deformed by the second deformation. The connecting regions 16 thus receive a curved profile over their width 17 (i.e. over the first cross-sectional area 13).

Cutting to size of the fluid container 1 furthermore takes place in both end regions 12, 23 such that a container length 34 of the fluid container 2 is set. The container length 34 is set to the maximum height 33 of the beverage container 2 provided for the fluid container 1.

Furthermore, an aperture 19 is arranged or produced in the region of the first end region 12 as part of the method.

LIST OF REFERENCE NUMERALS

1 fluid container
2 beverage container
3 axial direction
4 first end
5 second end
6 fluid container wall
7 first volume
8 fluid
9 central region
10 constant cross-sectional area
11 longitudinal axis
12 first end region
13 first cross-sectional area
14 first centroid point
15 radial direction
16 connecting region
17 width
18 length
19 aperture
20 body
21 first body end
22 second body end
23 second end region
24 shell
25 base
26 lid
27 wall region
28 second volume
29 liquid
30 circumferential direction
31 first core bevel
32 second core bevel
33 maximum height
34 container length
35 adhesive
36 third volume
37 lowest point

The invention claimed is:

1. A fluid container for arrangement in a beverage container:

wherein the fluid container extends in an axial direction between a first end and a second end and includes a first volume for storing a fluid inside a fluid container wall, wherein the fluid container includes, between the first end and the second end, a central region which includes, in the axial direction, a constant cross-sectional area which extends transversely to the axial direction, and a longitudinal axis which extends parallel to the axial direction and runs through a centroid point of the constant cross-sectional area, wherein the fluid container includes a first end region at least between the first end and the central region, wherein at least a part of the first end region is formed by the contacting of opposing regions of the fluid container wall, and wherein regions which contact one another form a connecting region that extends transversely to the longitudinal axis over a width and along the longitudinal axis over a length, and wherein at least one of:

the fluid container includes at least one aperture in the first end region, or at least part of the connecting region has a curved profile over the width, or the first end region includes, in the axial direction, first cross-sectional areas, which extend transversely to the axial direction, with first centroid points, wherein at least some of the centroid points are arranged so that they are spaced apart from the longitudinal axis in a radial direction.

2. The fluid container according to claim 1, wherein at least some of the first centroid points are arranged outside a first cross-sectional area associated with the respective first centroid point.

3. A beverage container at least comprising a shell with a base, a lid and a wall region connecting the base to the lid; wherein the beverage container includes a second volume configured to be partly filled with a liquid; wherein a fluid container according to claim 1 is arranged inside the second volume; and wherein the beverage container comprises at least a first core bevel in a circumferential direction between the base and the wall region, and a second core bevel arranged opposite the first core bevel and running around in the circumferential direction between the lid and the wall region, wherein a maximum height of the second volume extends between the first core bevel and the second core bevel, and the fluid container is arranged with the first end in the first core bevel and with the second end in the second core bevel and arranged in a form-fitting fashion in the second volume via the core bevels relative to a radial direction.

4. A beverage container at least comprising a shell with a base, a lid and a wall region connecting the base to the lid; wherein the beverage container includes a second volume configured to be partly filled with a liquid; wherein a fluid container according to claim 1 is arranged inside the second volume;

wherein the beverage container comprises at least a first core bevel in a circumferential direction between the base and the wall region, and a second core bevel arranged opposite the first core bevel and running around in the circumferential direction between the lid and the wall region, wherein a maximum height of the second volume extends between the first core bevel and the second core bevel, and the fluid container is arranged with the first end in the first core bevel and with the second end in the second core bevel and arranged in a form-fitting fashion in the second volume via the core bevels relative to a radial direction; and wherein the fluid container extends between the first end and the second end over a container length, wherein the container length is no more than 5 millimetres less than the maximum height.

* * * * *